US010276325B2

(12) United States Patent
Chung et al.

(10) Patent No.: US 10,276,325 B2
(45) Date of Patent: Apr. 30, 2019

(54) KEYBOARD DEVICE

(71) Applicant: Primax Electronics Ltd., Taipei (TW)

(72) Inventors: Yi-Chen Chung, Taipei (TW); Chin-Sung Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 106 days.

(21) Appl. No.: 15/585,634

(22) Filed: May 3, 2017

(65) Prior Publication Data

US 2018/0197698 A1 Jul. 12, 2018

(30) Foreign Application Priority Data

Jan. 6, 2017 (TW) ..... 106100445 A

(51) Int. Cl.

| | |
|---|---|
| ***H01H 3/12*** | (2006.01) |
| ***H01H 13/83*** | (2006.01) |
| ***H01H 13/84*** | (2006.01) |
| ***H01H 13/705*** | (2006.01) |
| ***H01H 13/702*** | (2006.01) |

(52) U.S. Cl.

CPC ..... *H01H 13/705* (2013.01); *H01H 3/125* (2013.01); *H01H 13/83* (2013.01); *H01H 13/84* (2013.01); *H01H 2209/002* (2013.01); *H01H 2219/062* (2013.01)

(58) Field of Classification Search

CPC ..... H01H 13/72; H01H 13/76; H01H 9/00; H01H 9/26; H01H 3/48; H01H 13/70; H01H 1/06; H01H 3/12; H01H 1/60; H01H 2227/032; H01H 2227/034; H01H 13/84; H01H 13/85; H01H 35/00; H01H 35/2614; H01H 35/2621; H01H 35/2628; H01H 35/2685; H01H 2211/032

See application file for complete search history.

(56) References Cited

U.S. PATENT DOCUMENTS

| | | | | |
|---|---|---|---|---|
| 7,378,609 | B1 * | 5/2008 | Fedorjaka | H01H 13/705 200/406 |
| 8,772,659 | B2 * | 7/2014 | Iwamoto | H01H 3/125 200/341 |
| 9,022,590 | B2 * | 5/2015 | Chen | H01H 13/83 362/23.03 |

* cited by examiner

*Primary Examiner* — Anthony R Jimenez
(74) *Attorney, Agent, or Firm* — Muncy, Geissler, Olds & Lowe, P.C.

(57) ABSTRACT

A keyboard device includes a light guide plate, a base plate, plural keys and plural surround-type soundproof elements. The base plate is located over the light guide plate. The plural keys are connected with the base plate. The membrane circuit board is arranged between the plural keys and the base plate. The plural surround-type soundproof elements are aligned with the corresponding keys. Each surround-type soundproof element is disposed on the light guide plate, the base plate or the membrane circuit board. While one of the plural keycaps is depressed and moved downwardly relative to the base plate, a sealed space is defined by the corresponding keycap and the corresponding surround-type soundproof element.

20 Claims, 12 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices.

The structures and the functions of a conventional keyboard device 1 will be illustrated as follows. Please refer to FIGS. 1, 2 and 3. FIG. 1 is a schematic top view illustrating the outer appearance of a conventional keyboard device. FIG. 2 is a schematic exploded view illustrating a portion of the keyboard device of FIG. 1 and taken along a viewpoint. FIG. 3 is a schematic exploded view illustrating a portion of the keyboard device of FIG. 1 and taken along another viewpoint. For succinctness, only one key 10' and related components are shown in FIGS. 2 and 3.

The conventional keyboard device 1 comprises plural keys 10 and 10', a base plate 11 and a membrane circuit board 12. The membrane circuit board 12 comprises plural membrane switches 121 corresponding to the plural keys 10 and 10'. Each of the plural keys 10 and 10' comprises a keycap 101, at least one scissors-type connecting element 102 and an elastic element 103. The scissors-type connecting element 102 is connected between the keycap 101 and the base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The elastic element 103 is arranged between the keycap 101 and the base plate 11. Moreover, the elastic element 103 comprises a contacting part 1031.

While the keycap 101 of any key 10 or 10' is depressed and moved downwardly relative to the base plate 11, the first frame 1021 and the second frame 1022 of the scissors-type connecting element 102 are switched from an open-scissors state to a stacked state. Moreover, as the keycap 101 is moved downwardly to compress the elastic element 103, the corresponding membrane switch 121 is pushed and triggered by the contacting part 1031 of the elastic element 103. Consequently, the keyboard device 1 generates a corresponding key signal. When the keycap 101 of the key 10 or 10' is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

As shown in the drawings, the length L1 of the key 10' is much larger than the width W1 of the key 10'. The key 10' further comprises a first stabilizer bar 104, a second stabilizer bar 105 and a reinforcement element 106. The reinforcement element 106 is disposed on a bottom surface of the keycap 101. Moreover, the reinforcement element 106 is a substantially a rectangular ring-shape rod with plural bent segments. The reinforcement element 106 is used to increase the structural strength of the keycap 101 and prevent from the deformation or the rocking condition of the keycap 101 in response to the external force. The first stabilizer bar 104 comprises a first transverse bar part 1041 and two first hook parts 1042. The two first hook parts 1042 are located at two ends of the first stabilizer bar 104, respectively. The second stabilizer bar 105 comprises a second transverse bar part 1051 and two second hook parts 1052. The two second hook parts 1052 are located at two ends of the second stabilizer bar 105, respectively.

The base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises a first locking hole 1111 and a third locking hole 1112. The second connecting structure 112 comprises a second locking hole 1121 and a fourth locking hole 1122. The second locking hole 1121 corresponds to the first locking hole 1111, and the fourth locking hole 1122 corresponds to the third locking hole 1112.

The first transverse bar part 1041 of the first stabilizer bar 104 and the second transverse bar part 1051 of the second stabilizer bar 105 are pivotally coupled to the keycap 101 of the key 10'. The two first hook parts 1042 of the first stabilizer bar 104 are penetrated through the first locking hole 1111 of the first connecting structure 111 and the second locking hole 1121 of the second connecting structure 112, respectively. The two second hook parts 1052 of the second stabilizer bar 105 are penetrated through the third locking hole 1112 of the first connecting structure 111 and the fourth locking hole 1122 of the second connecting structure 112, respectively. Moreover, all of the first stabilizer bar 104, the second stabilizer bar 105, the reinforcement element 106 and the base plate 11 are made of metallic material.

FIG. 4 schematically illustrates the actions of the first stabilizer bar and the second stabilizer bar of the keyboard device as shown in FIG. 1. While the keycap 101 of the key 10' is moved upwardly or downwardly relative to the base plate 11, the first stabilizer bar 104 is moved in the direction D11 or the direction D12 and rotated in the direction D13 or the direction D14. Similarly, the second stabilizer bar 105 is moved in the direction D11 or the direction D12 and rotated in the direction D13 or the direction D14. By this design, the key 10' is kept stable and not inclined while the key 10' is moved upwardly or downwardly relative to the base plate 11. Moreover, this design is helpful to increase the strength of the keycap 101.

However, the conventional keyboard device 1 still has some drawbacks. While the keycap 101 of any key 10 or 10' is depressed and downwardly relative to the base plate 11, many sounds are generated. For example, as the first frame 1021 and the second frame 1022 of the scissors-type connecting element 102 are switched from the open-scissors state to the stacked state, a click sound is generated. Moreover, the keycap 101, the first transverse bar part 1041 of the first stabilizer bar 104, the second transverse bar part 1051 of the second stabilizer bar 105 and the reinforcement element 106 collide with the membrane circuit board 12 to generate a sound. Especially when the kinetic energy from collision is transferred downwardly to the base plate 11, the sound is obvious. Since the two first hook parts 1042 of the first stabilizer bar 104 are respectively penetrated through the first locking hole 1111 of the first connecting structure 111 and the second locking hole 1121 of the second connecting structure 112, the collision between these components also generates a sound. Since the two second hook parts 1052 of the second stabilizer bar 105 are respectively penetrated through the third locking hole 1112 of the first connecting structure 111 and the fourth locking hole 1122 of the second connecting structure 112, the collision between these components also generates a sound. Generally, these sounds are unpleasant noise to the user.

In other words, the conventional keyboard device needs to be further improved.

SUMMARY OF THE INVENTION

An object of the present invention provides a keyboard device having a function of reducing noise. In accordance with the present invention, plural surround-type soundproof elements corresponding to plural keys are disposed on a light guide plate, a base plate or a membrane circuit board. Consequently, when the keycap of any key is moved downwardly relative to the base plate, the generated click sound is reduced. Since a sealed space is defined by the keycap of any key and the corresponding surround-type soundproof element, the sound generated by the components within the sealed space will be blocked from being transmitted to the region outside the sealed space. Consequently, when the keyboard device is operated by the user, the generated noise is reduced. Moreover, the operating comfort to the user is enhanced.

In accordance with an aspect of the present invention, there is provided a keyboard device. The keyboard device includes plural keys, a base plate, a membrane circuit board and plural surround-type soundproof elements. The plural keys include plural keycaps, respectively. The plural keys are connected with the base plate. The membrane circuit board is arranged between the plural keycaps and the base plate, and includes plural membrane switches corresponding to the plural keys. The plural surround-type soundproof elements are aligned with the corresponding keys, and disposed on the base plate or the membrane circuit board. While one of the plural keycaps is depressed and moved downwardly relative to the base plate, a sealed space is defined by the corresponding keycap and the corresponding surround-type soundproof element.

In accordance with another aspect of the present invention, there is provided a keyboard device. The keyboard device includes plural keys, a base plate, a membrane circuit board, a light guide plate and plural surround-type soundproof elements. The plural keys include plural keycaps, respectively. The plural keys are connected with the base plate. The membrane circuit board is arranged between the plural keycaps and the base plate, and includes plural membrane switches corresponding to the plural keys. The light guide plate is located under the base plate. When a light beam is received by the light guide plate, the light beam is guided upwardly to the plural keys by the light guide plate. The plural surround-type soundproof elements are aligned with the corresponding keys, disposed on the light guide plate and penetrated upwardly through the base plate and the membrane circuit board. While one of the plural keycaps is depressed and moved downwardly relative to the base plate, a sealed space is defined by the corresponding keycap and the corresponding surround-type soundproof element.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
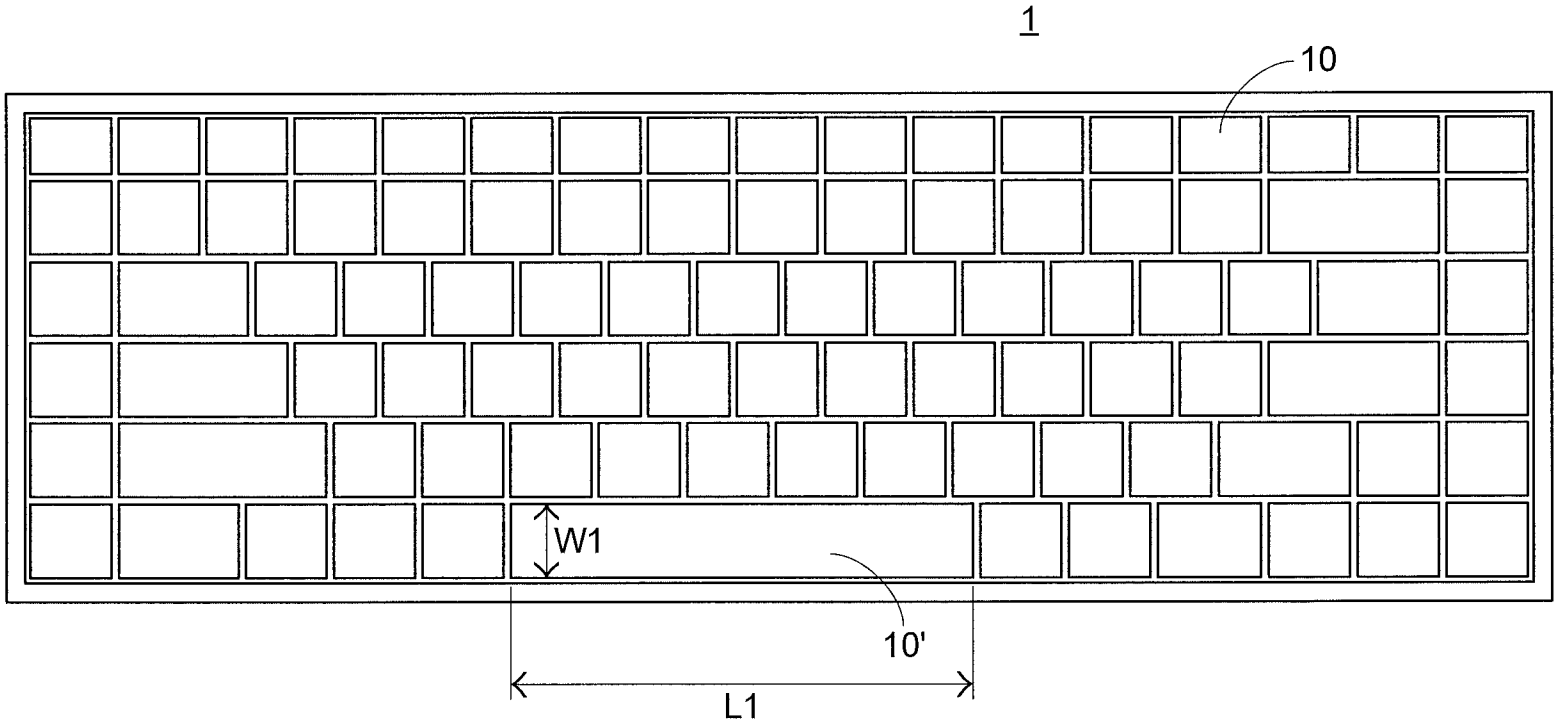
FIG.1 PRIOR ART
FIG. 1 is a schematic top view illustrating the outer appearance of a conventional keyboard device.
Figure 2:
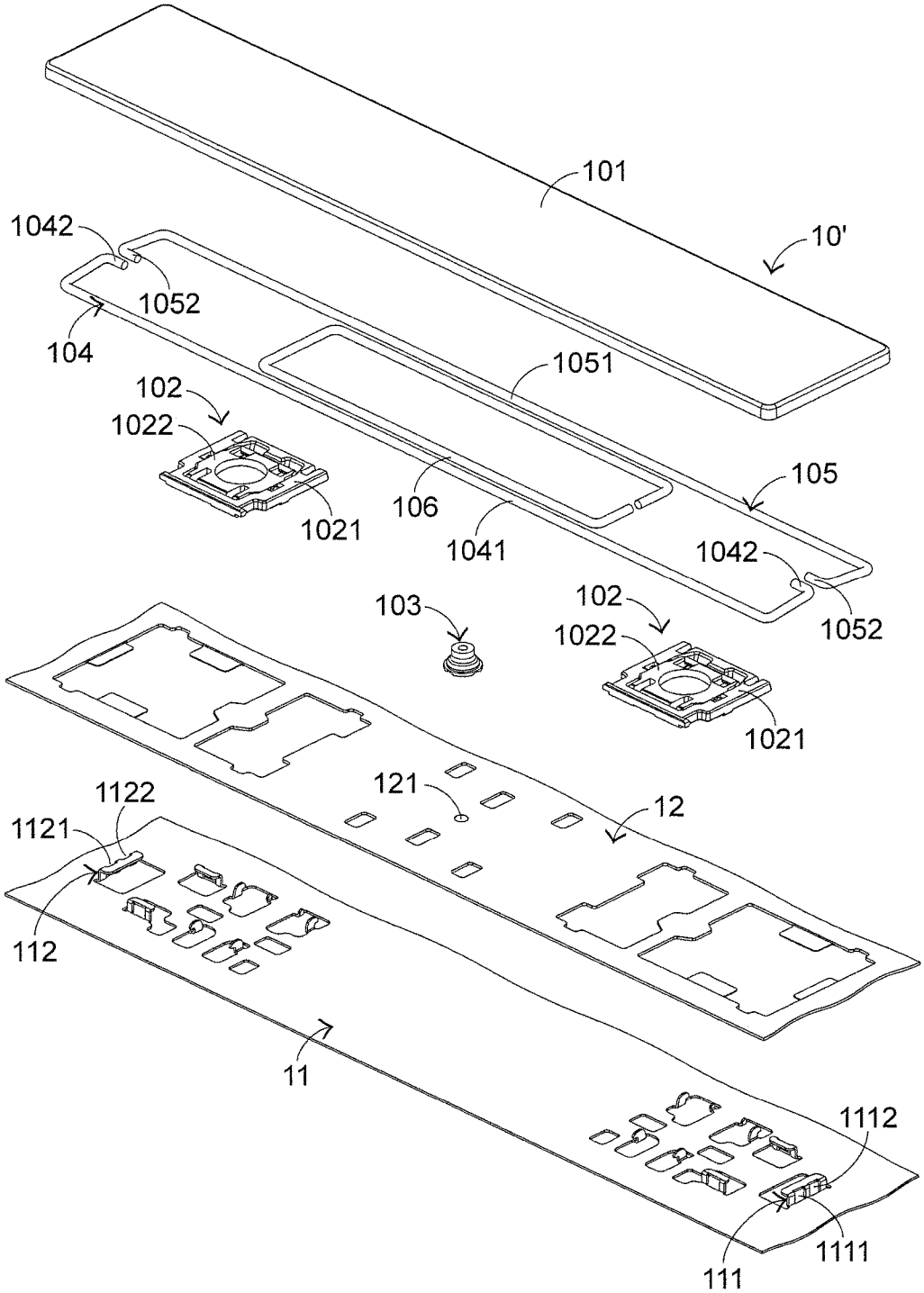
FIG.2 PRIOR ART
FIG. 2 is a schematic exploded view illustrating a portion of the keyboard device of FIG. 1 and taken along a viewpoint.
Figure 3:
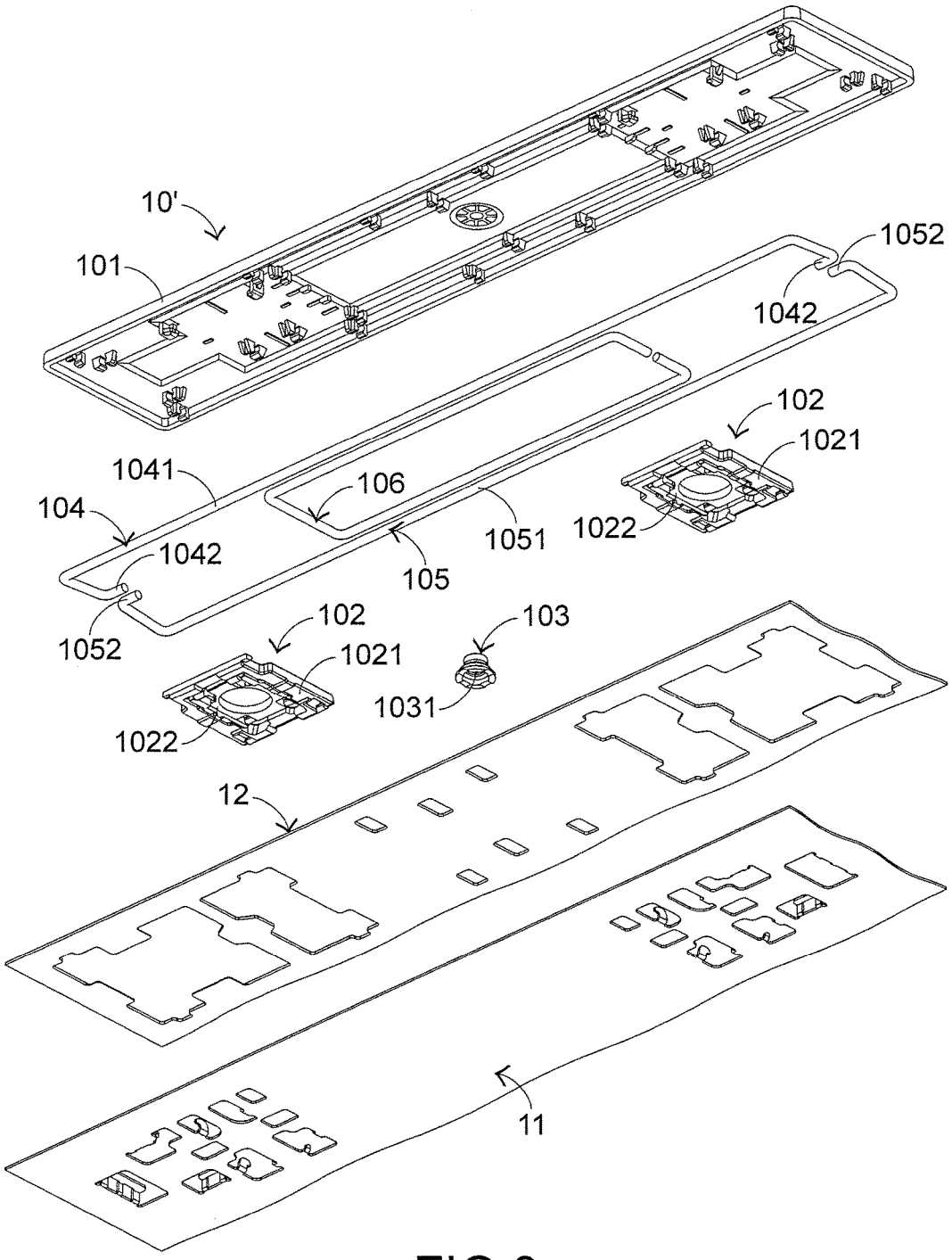
FIG.3 PRIOR ART
FIG. 3 is a schematic exploded view illustrating a portion of the keyboard device of FIG. 1 and taken along another viewpoint.
Figure 4:
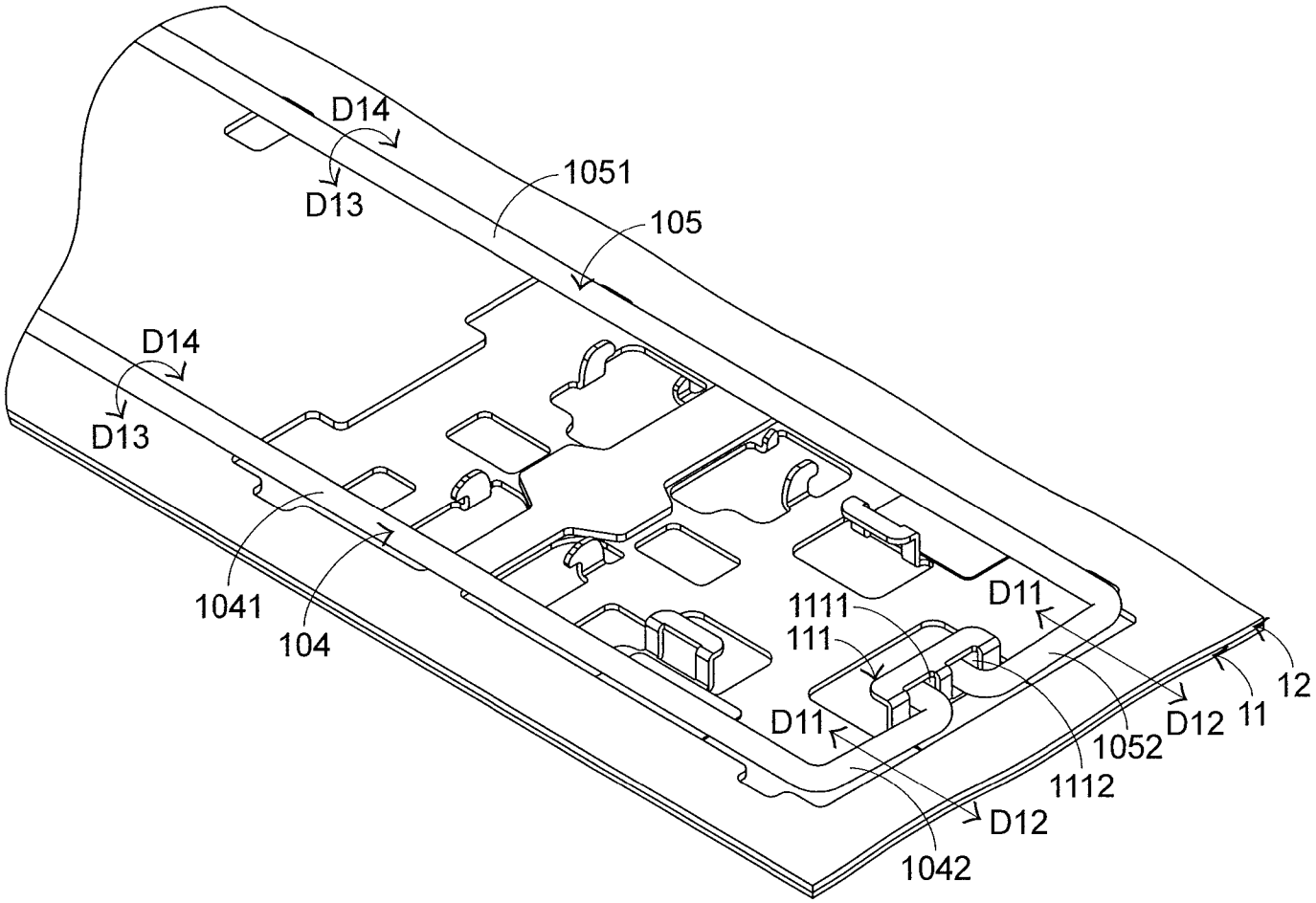
FIG.4 PRIOR ART
FIG. 4 schematically illustrates the actions of the first stabilizer bar and the second stabilizer bar of the keyboard device as shown in FIG. 1.
Figure 5:
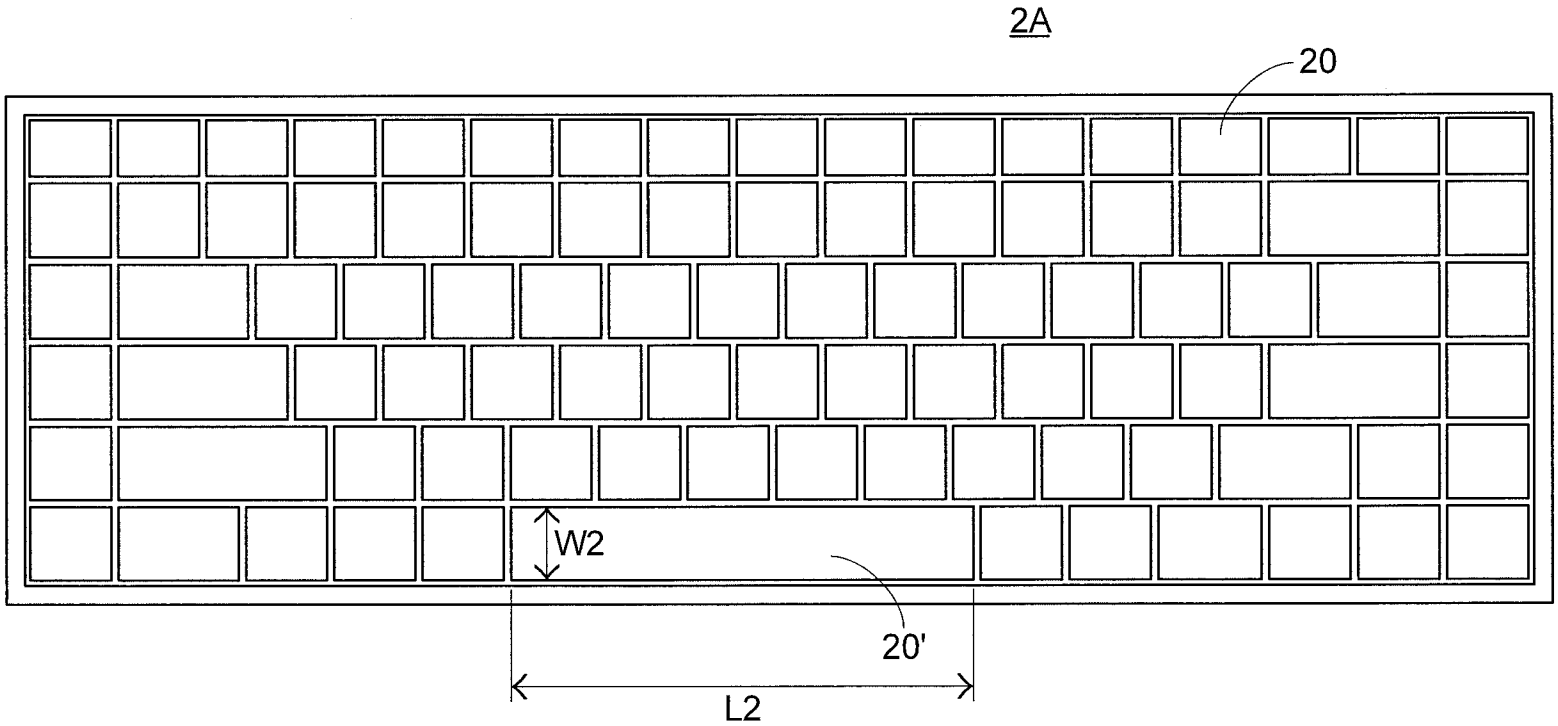
FIG. 5 is a schematic top view illustrating the outer appearance of a keyboard device according to a first embodiment of the present invention.
Figure 6:
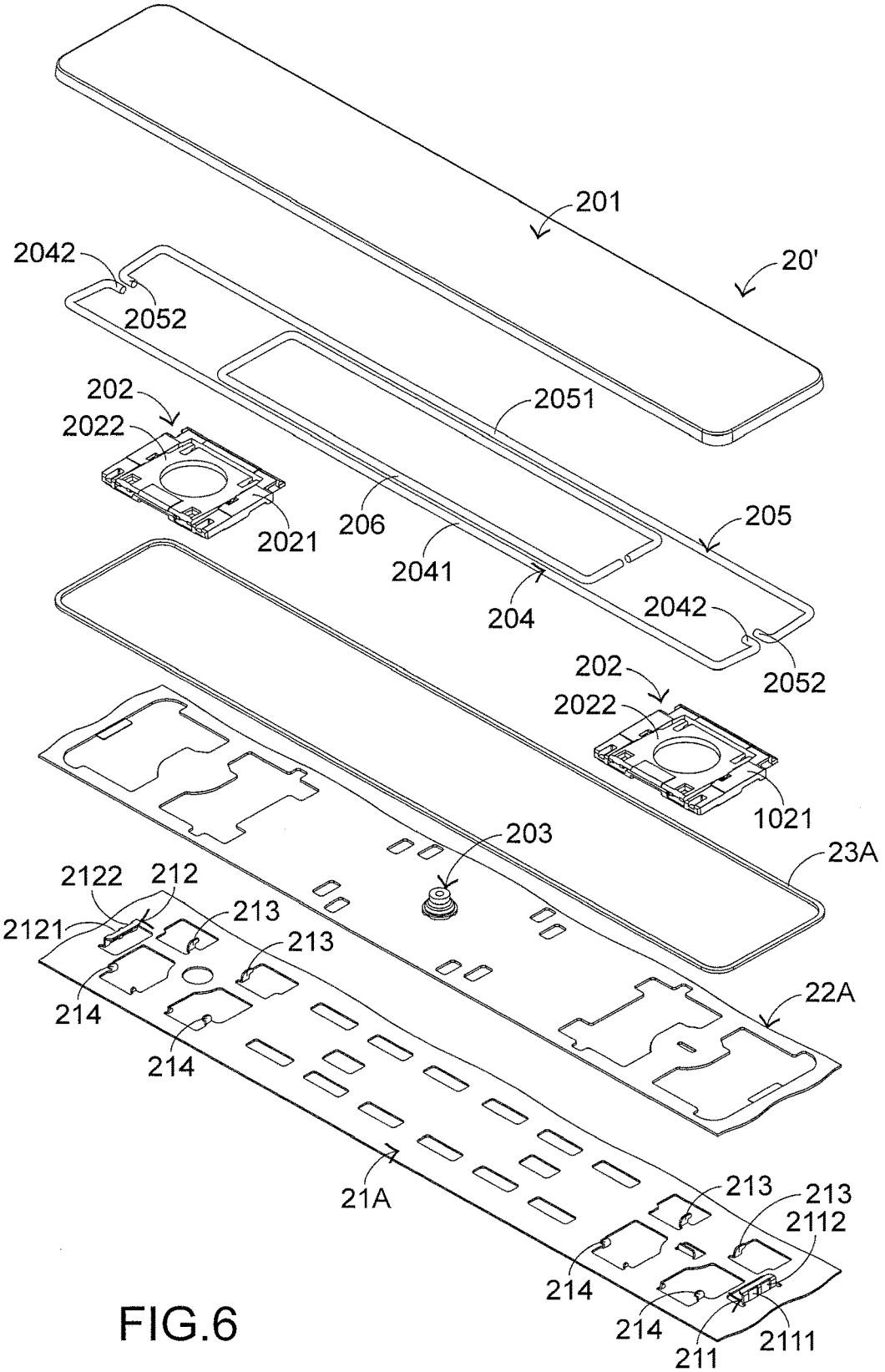
FIG. 6 is a schematic exploded view illustrating a portion of the keyboard device of FIG. 5 and taken along a viewpoint.
Figure 7:
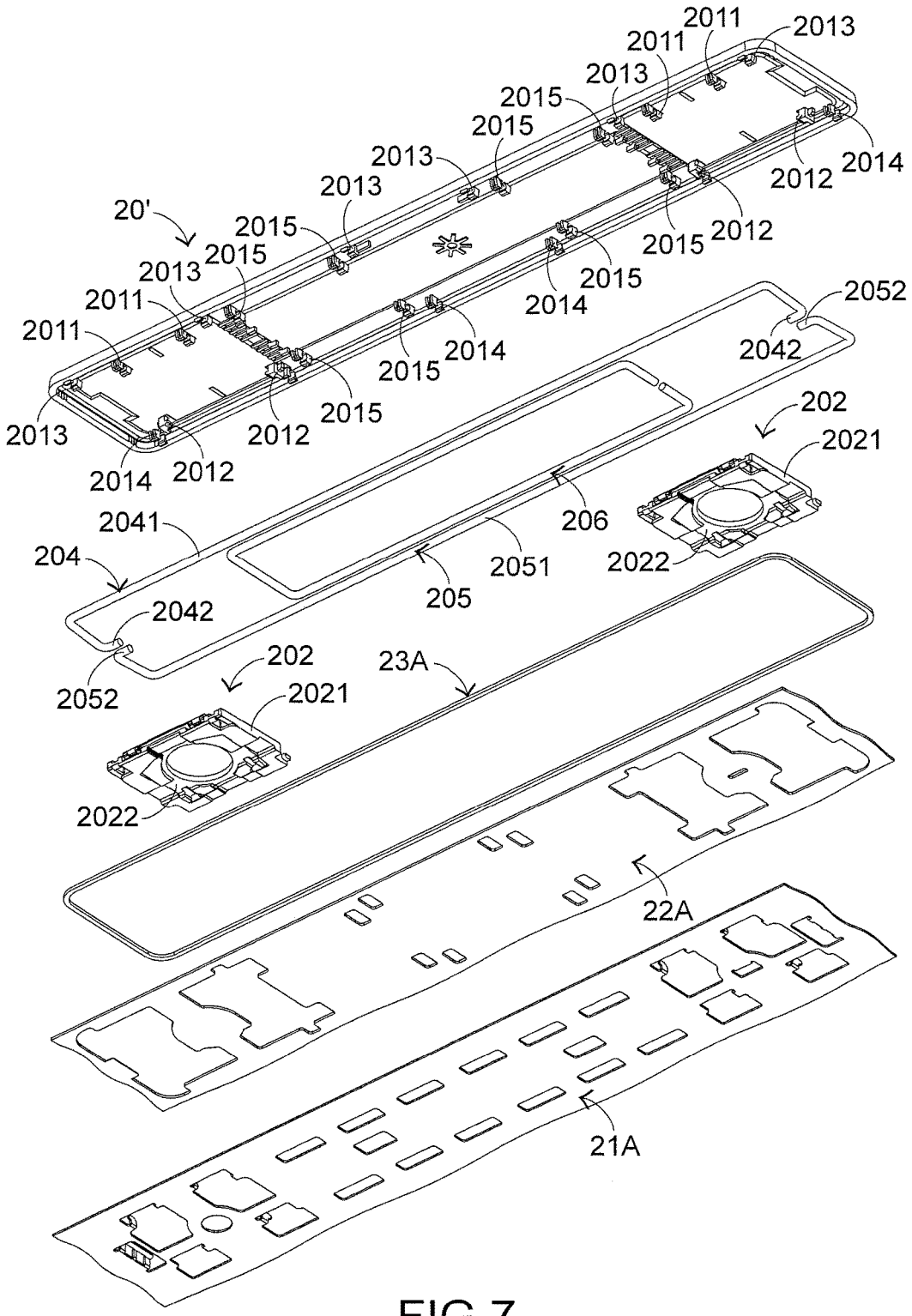
FIG. 7 is a schematic exploded view illustrating a portion of the keyboard device of FIG. 5 and taken along another viewpoint.

Please refer to FIGS. 5, 6 and 7. FIG. 5 is a schematic top view illustrating the outer appearance of a keyboard device according to a first embodiment of the present invention. FIG. 6 is a schematic exploded view illustrating a portion of the keyboard device of FIG. 5 and taken along a viewpoint. FIG. 7 is a schematic exploded view illustrating a portion of the keyboard device of FIG. 5 and taken along another viewpoint. For succinctness, only one key 20' and related components are shown in FIGS. 6 and 7. The keyboard device 2A comprises plural keys 20 and 20', a base plate 21A and a membrane circuit board 22A. The membrane circuit board 22A is arranged between the plural keys 20, 20' and the base plate 21A. These keys 20 and 20' are classified into some types, e.g., ordinary keys, numeric keys and function keys. When one of the keys 20 and 20' is depressed by the user's finger, the keyboard device 2A generates a corresponding key signal to the computer, and thus the computer executes a function corresponding to the depressed key. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

Figure 8:
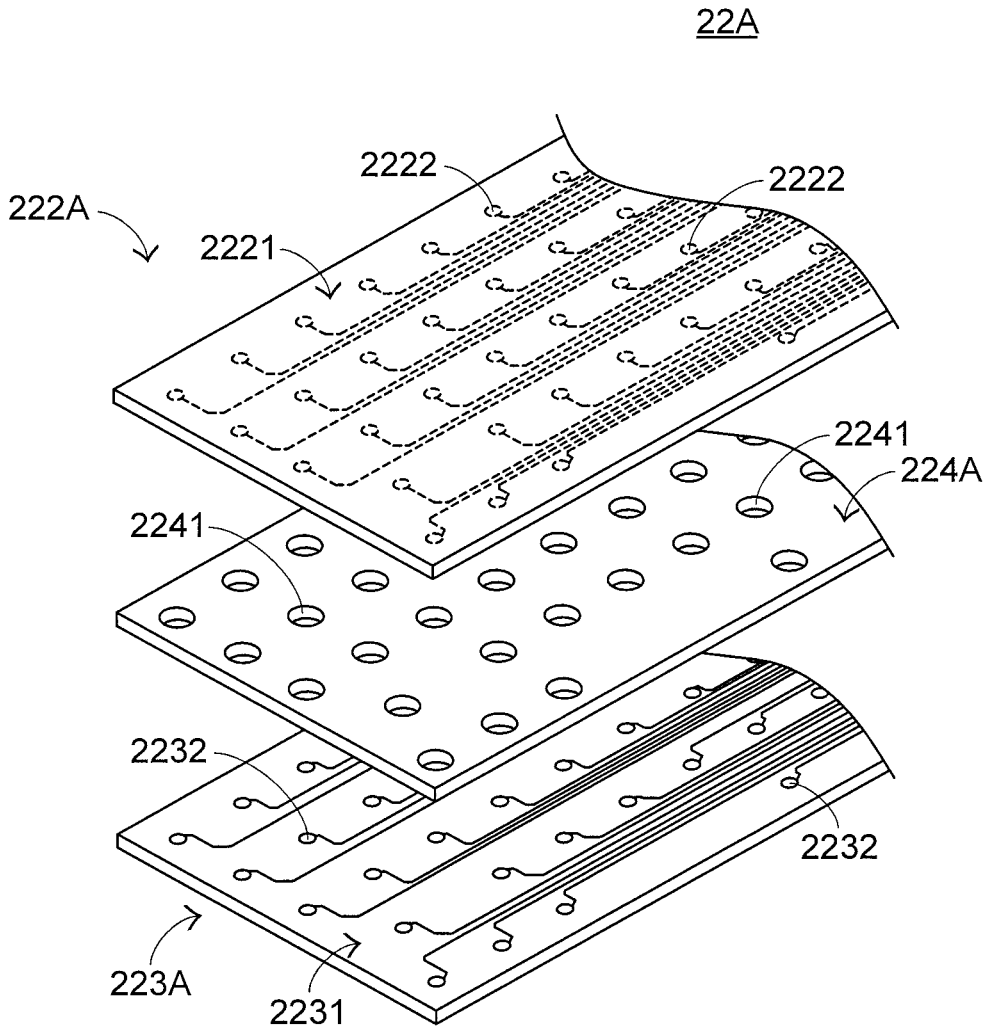
FIG. 8 is a schematic exploded view illustrating the membrane circuit board of the keyboard device as shown in FIG. 5.

FIG. 8 is a schematic exploded view illustrating the membrane circuit board of the keyboard device as shown in FIG. 5. The membrane circuit board 22A comprises plural film layers, which are arranged in a stack form. In this embodiment, the membrane circuit board 22A comprises an upper film layer 222A and a lower film layer 223A. A first circuit pattern 2221 is formed on a bottom surface of the upper film layer 222A. The first circuit pattern 2221 comprises plural upper contacts 2222 corresponding to the plural keys 20 and 20'. A second circuit pattern 2231 is formed on a top surface of the lower film layer 223A. The second circuit pattern 2231 comprises plural lower contacts 2232 corresponding to the plural upper contacts 2222. Each of the upper contacts 2222 and the corresponding lower contact 2232 are separated from each other by a spacing interval. Moreover, each of the upper contacts 2222 and the corresponding lower contact 2232 are collectively defined as a membrane switch 221. Moreover, for maintaining the spacing interval between each upper contact 2222 and the corresponding lower contact 2232, the membrane circuit board 22A further comprises an intermediate film layer 224A. The intermediate film layer 224A is arranged between the upper film layer 222A and the lower film layer 223A. In addition, the intermediate film layer 224A comprises plural perforations 2241 corresponding to the plural upper contacts 2222 and the plural lower contacts 2232. Preferably but not exclusively, at least one of the upper film layer 222A, the lower film layer 223A and the intermediate film layer 224A is made of polycarbonate (PC), polyethylene terephthalate (PET), polymethylmethacrylate (PMMA), polyurethane (PU) or polyimide (PI).

Each of the plural keys 20 and 20' comprises a keycap 201, at least one connecting element 202 and an elastic element 203. The connecting element 202 is connected between the keycap 201 and the base plate 21A. Through the connecting element 202, the keycap 201 is moved upwardly or downwardly relative to the base plate 21A. The elastic element 203 is arranged between the keycap 201 and the base plate 21A. Moreover, the elastic element 203 comprises a contacting part 2031. In this embodiment, the connecting element 202 is a scissors-type connecting element. Moreover, the connecting element 202 comprises a first frame 2021 and a second frame 2022. The second frame 2022 is pivotally coupled to the first frame 2021. Consequently, the first frame 2021 and the second frame 2022 can be swung relative to each other.

Each keycap 201 comprises a connecting lock part 2011 and a connecting hook part 2012. The base plate 21A comprises a first hook 213 and a second hook 214. The first hook 213 and the second hook 214 are protruded upwardly and penetrated through the membrane circuit board 22A. A first end of the first frame 2021 is connected with the connecting lock part 2011 of the keycap 201. A second end of the first frame 2021 is connected with the second hook 214 of the base plate 21A. A first end of the second frame 2022 is connected with the connecting hook part 2012 of the keycap 201. A second end of the second frame 2022 is connected with the first hook 213 of the base plate 21A. The connecting relationships between the connecting element 202, the base plate 21A and the keycap 201 are presented herein for purpose of illustration and description only.

Figure 9:
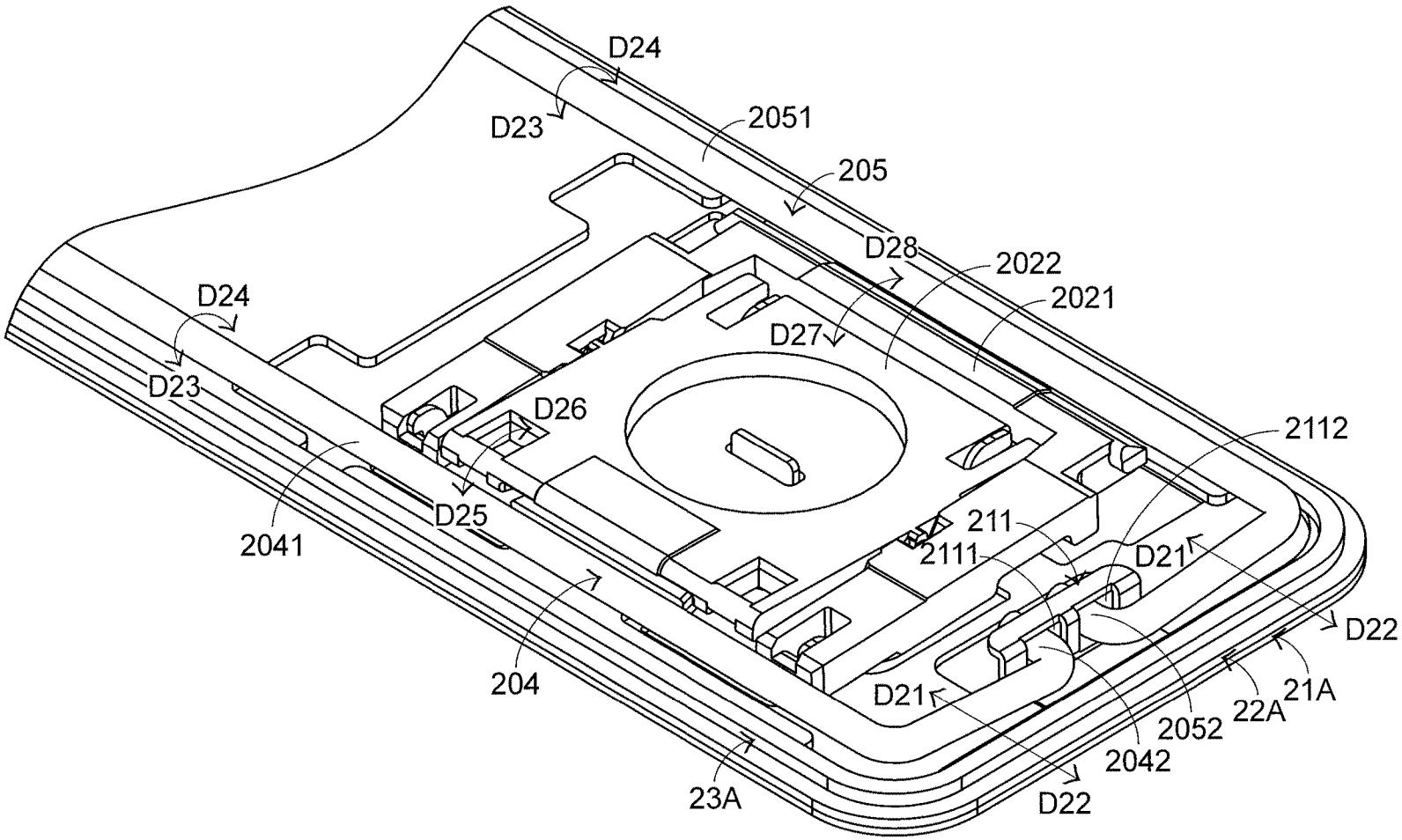
FIG. 9 schematically illustrates the actions of the connecting element, the first stabilizer bar and the second stabilizer bar of the keyboard device as shown in FIG. 5.

FIG. 9 schematically illustrates the actions of the connecting element, the first stabilizer bar and the second stabilizer bar of the keyboard device as shown in FIG. 5. Please refer to FIGS. 8 and 9. While the keycap 201 of any key 20 or 20' is depressed and moved downwardly relative to the base plate 21A, the first frame 2021 and the second frame 2022 of the connecting element 202 are switched from an open-scissors state to a stacked state. As shown in FIG. 9, the first frame 2021 is rotated in a direction D28 and the second frame 2022 is rotated in a direction D25. Moreover, as the keycap 201 is moved downwardly to compress the elastic element 203, the corresponding upper contact 2222 is pushed and triggered by the contacting part 2031 of the elastic element 203. Consequently, the corresponding upper contact 2222 is contacted with the corresponding lower contact 2232 through the corresponding perforation 2241. In such way, the corresponding membrane switch 221 is electrically conducted, and the keyboard device 2A generates a corresponding key signal. When the keycap 201 of the key 20 or 20' is no longer depressed, the keycap 201 is moved upwardly relative to the base plate 21A in response to an elastic force of the elastic element 203. Meanwhile, the first frame 2021 and the second frame 2022 are switched from the stacked state to the open-scissors state. As shown in FIG. 9, the first frame 2021 is rotated in a direction D27 and the second frame 2022 is rotated in a direction D26. Consequently, the keycap 201 is returned to its original position.

As shown in FIGS. 6, 7 and 9, the length L2 of the key 20' is much larger than the width W2 of the key 20'. The key 20' further comprises a first stabilizer bar 204, a second stabilizer bar 205 and a reinforcement element 206. The reinforcement element 206 is disposed on a bottom surface of the keycap 201. Moreover, the reinforcement element 206 is a substantially a rectangular ring-shape rod with plural bent segments. The reinforcement element 206 is used to increase the structural strength of the keycap 201 and prevent from the deformation or the rocking condition of the keycap 201 in response to the external force. The first stabilizer bar 204 comprises a first transverse bar part 2041 and two first hook parts 2042. The two first hook parts 2042 are located at two ends of the first stabilizer bar 204, respectively. The second stabilizer bar 205 comprises a second transverse bar part 2051 and two second hook parts 2052. The two second hook parts 2052 are located at two ends of the second stabilizer bar 205, respectively.

As mentioned above, the length L2 of the key 20' is much larger than the width W2 of the key 20'. The keycap 201 of the key 20' further comprises plural first stabilizer lock parts 2013, plural second stabilizer lock parts 2014 and plural reinforcement lock parts 2015. The first transverse bar part 2041 is penetrated through the plural first stabilizer lock parts 2013 and pivotally coupled to the plural first stabilizer lock parts 2013. The second transverse bar part 2051 is penetrated through the plural second stabilizer lock parts 2014 and pivotally coupled with the plural second stabilizer lock parts 2014. The reinforcement element 206 is fixed on the keycap 201 through the plural reinforcement lock parts 2015.

The base plate 21A further comprises a first connecting structure 211 and a second connecting structure 212. The first connecting structure 211 and the second connecting structure 212 are protruded upwardly, and penetrated through the membrane circuit board 22A. The first connecting structure 211 comprises a first locking hole 2111 and a third locking hole 2112. The second connecting structure 212 comprises a second locking hole 2121 and a fourth locking hole 2122. The second locking hole 2121 corresponds to the first locking hole 2111, and the fourth locking hole 2122 corresponds to the third locking hole 2112. The two first hook parts 2042 of the first stabilizer bar 204 are penetrated through the first locking hole 2111 of the first connecting structure 211 and the second locking hole 2121 of the second connecting structure 212, respectively. The two second hook parts 2052 of the second stabilizer bar 205 are penetrated through the third locking hole 2112 of the first connecting structure 211 and the fourth locking hole 2122 of the second connecting structure 212, respectively.

While the keycap 201 of the key 20' is moved upwardly or downwardly relative to the base plate 21A, the first stabilizer bar 204 is moved in the direction D21 or the direction D22 and rotated in the direction D23 or the direction D24, and the first transverse bar part 2041 of the first stabilizer bar 204 is rotated relative to the plural first stabilizer lock parts 2013. Similarly, the second stabilizer bar 205 is moved in the direction D21 or the direction D22 and rotated in the direction D23 or the direction D24, and the second transverse bar part 2051 of the second stabilizer bar 205 is rotated relative to the plural second stabilizer lock parts 2014. By this design, the key 20' is kept stable and not inclined while the key 20' is moved upwardly or downwardly relative to the base plate 21A. Moreover, this design is helpful to increase the strength of the keycap 201.

In accordance with a feature of the present invention, the base plate 21A of the keyboard device 2A further comprises plural surround-type soundproof elements 23A. In an embodiment, the surround-type soundproof elements 23A are elastic vibration absorbers or sound absorbers. For example, the elastic vibration absorbers are made of silicone rubber or pressure sensitive adhesive (PSA). Preferably but not exclusively, the surround-type soundproof elements 23A are formed on the membrane circuit board 22A by a screen printing process, a transfer printing process, a dispensing process or an adhesive attaching process.

Moreover, these surround-type soundproof elements 23A are disposed on the top surface of the upper film layer 222A of the membrane circuit board 22A. Each surround-type soundproof element 23A is aligned with the corresponding keycap 201, and arranged around the first stabilizer bar 204, the second stabilizer bar 205, the reinforcement element 206 and the connecting element 202.

Figure 10:
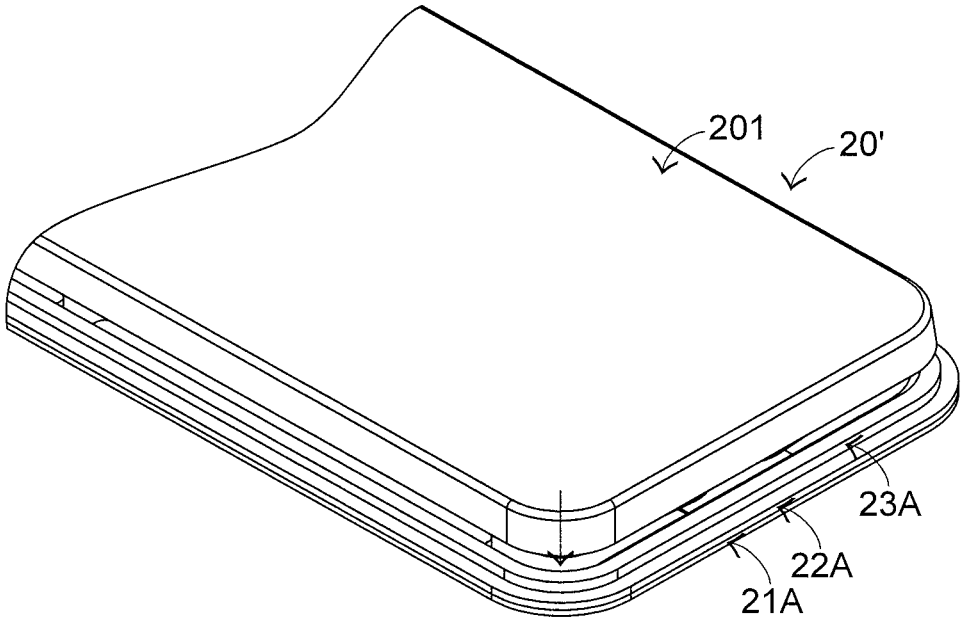
FIG. 10 is a schematic perspective view illustrating a portion of the keyboard device as shown in FIG. 5, in which the keycap of the key is not depressed.
Figure 11:
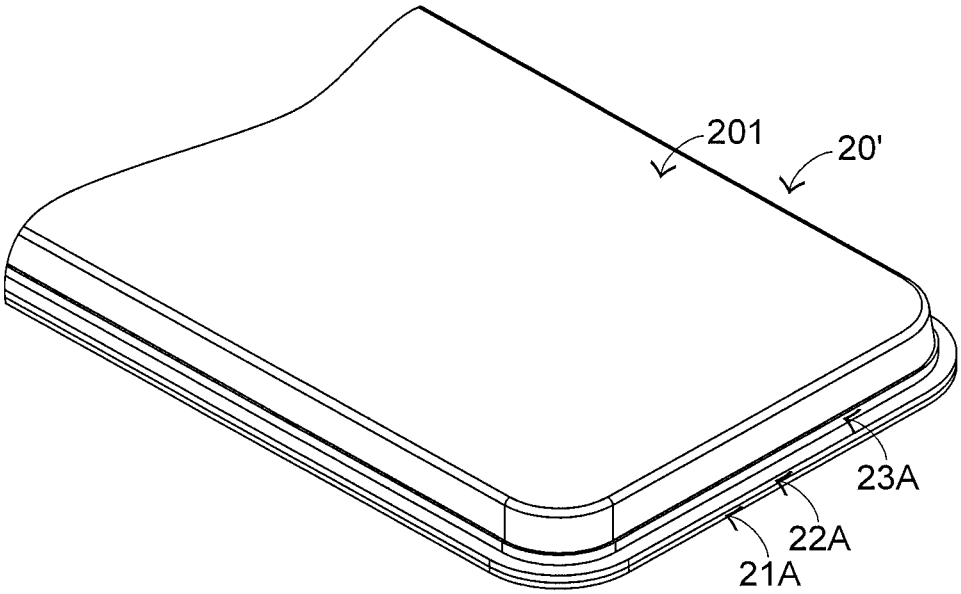
FIG. 11 is a schematic perspective view illustrating a portion of the keyboard device as shown in FIG. 5, in which the keycap of the key is depressed.

Please refer to FIGS. 10 and 11. FIG. 10 is a schematic perspective view illustrating a portion of the keyboard device as shown in FIG. 5, in which the keycap of the key is not depressed. FIG. 11 is a schematic perspective view illustrating a portion of the keyboard device as shown in FIG. 5, in which the keycap of the key is depressed. While the keycap 201 of any key 20 or 20' is depressed and moved downwardly relative to the base plate 21A, the keycap 201 collides and contacts with the corresponding surround-type soundproof element 23A of the membrane circuit board 22A. Consequently, a sealed space is defined by the keycap 201 and the surround-type soundproof element 23A. At this moment, the surround-type soundproof element 23A is capable of absorbing the kinetic energy of the keycap 201. Consequently, the impact resulted from the collision is alleviated, and the click sound to be transmitted to the base plate 21A is decreased. Moreover, since the sealed space is defined by the keycap 201 and the surround-type soundproof element 23A, the sound generated in the sealed space is blocked.

As mentioned above, while the keycap 201 of any key 20 or 20' is depressed and moved downwardly relative to the base plate 21A, a click signal is generated because the first frame 2021 and the second frame 2022 of the connecting element 202 are switched from the open-scissors state to the stacked state. The sealed space defined by the keycap 201 and the surround-type soundproof element 23A can block the click sound from being transmitted to the region outside the sealed space. Moreover, another click sound is generated when the first transverse bar part 2041 of the first stabilizer bar 204, the second transverse bar part 2051 of the second stabilizer bar 205 and the reinforcement element 206 collide with the membrane circuit board 22A. The sealed space defined by the keycap 201 and the surround-type soundproof element 23A can block the click sound from being transmitted to the region outside the sealed space. Moreover, the collision between the two first hook parts 2042 of the first stabilizer bar 204 and the first locking hole 2111 of the first connecting structure 211 and the second locking hole 2121 of the second connecting structure 212 may also generate a sound. Due to the sealed space, the sound is blocked from being transmitted to the region outside the sealed space. Moreover, the collision between the two second hook parts 2052 of the second stabilizer bar 205 and the third locking hole 2112 of the first connecting structure 211 and the fourth locking hole 2122 of the second connecting structure 212 may also generate another sound. Due to the sealed space, the sound is blocked from being transmitted to the region outside the sealed space.

Figure 12:
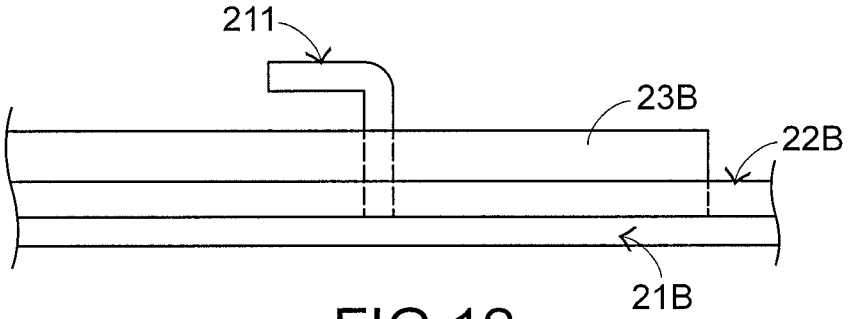
FIG. 12 is a schematic cross-sectional view illustrating portions of a base plate, a membrane circuit board and a surround-type soundproof element of a keyboard device according to a second embodiment of the present invention.

FIG. 12 is a schematic cross-sectional view illustrating portions of a base plate, a membrane circuit board and a surround-type soundproof element of a keyboard device according to a second embodiment of the present invention. Except for the following items, the structures of the keyboard device of this embodiment are substantially identical to those of the keyboard device of the first embodiment, and are not redundantly described herein. In comparison with the first embodiment, the surround-type soundproof element 23B of this embodiment is disposed on the base plate 21B and penetrated upwardly through the membrane circuit board 22B. Like the example of FIGS. 10 and 11, a sealed space is defined by the keycap of any key (not shown) and the surround-type soundproof element 23B while the keycap is depressed and moved downwardly relative to the base plate 21B to collide and contact with the corresponding surround-type soundproof element 23B on the base plate 21B. Since the surround-type soundproof element 23B is capable of absorbing the kinetic energy of the keycap, the impact resulted from the collision is alleviated and the click sound to be transmitted to the base plate 21B is decreased. Moreover, since the sealed space is defined by the keycap and the surround-type soundproof element 23B, the sound generated in the sealed space is blocked.

Figure 13:
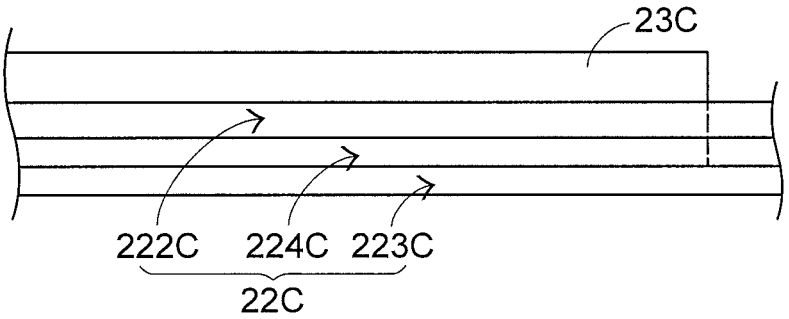
FIG. 13 is a schematic cross-sectional view illustrating portions of a membrane circuit board and a surround-type soundproof element of a keyboard device according to a third embodiment of the present invention.

FIG. 13 is a schematic cross-sectional view illustrating portions of a membrane circuit board and a surround-type soundproof element of a keyboard device according to a third embodiment of the present invention. Except for the following items, the structures of the keyboard device of this embodiment are substantially identical to those of the keyboard device of the first embodiment, and are not redundantly described herein. In comparison with the first embodiment, the surround-type soundproof element 23C of this embodiment is disposed on a top surface of the lower film layer 223C of the membrane circuit board 22C and penetrated through the intermediate film layer 224C and the upper film layer 222C of the membrane circuit board 22C. Like the example of FIGS. 10 and 11, a sealed space is defined by the keycap of any key (not shown) and the surround-type soundproof element 23C while the keycap is depressed and moved downwardly relative to the base plate (not shown) to collide and contact with the corresponding surround-type soundproof element 23C on the membrane circuit board 22C. Since the surround-type soundproof element 23C is capable of absorbing the kinetic energy of the keycap, the impact resulted from the collision is alleviated and the click sound to be transmitted to the base plate is decreased. Moreover, since the sealed space is defined by the keycap and the surround-type soundproof element 23C, the sound generated in the sealed space is blocked.

Figure 14:
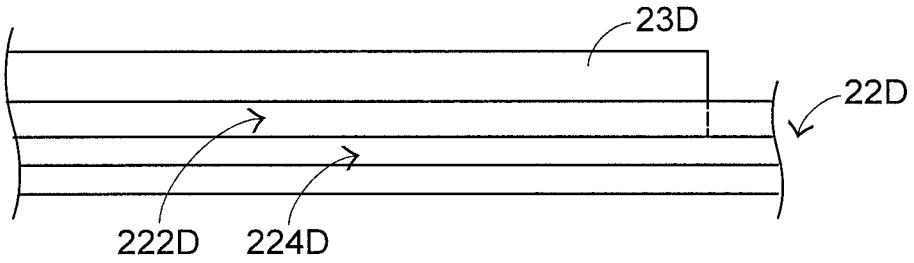
FIG. 14 is a schematic cross-sectional view illustrating portions of a membrane circuit board and a surround-type soundproof element of a keyboard device according to a fourth embodiment of the present invention.

FIG. 14 is a schematic cross-sectional view illustrating portions of a membrane circuit board and a surround-type soundproof element of a keyboard device according to a fourth embodiment of the present invention. Except for the following items, the structures of the keyboard device of this embodiment are substantially identical to those of the keyboard device of the first embodiment, and are not redundantly described herein. In comparison with the first embodiment, the surround-type soundproof element 23D of this embodiment is disposed on a top surface of the intermediate film layer 224D of the membrane circuit board 22D and penetrated through the upper film layer 222D of the membrane circuit board 22D. Like the example of FIGS. 10 and 11, a sealed space is defined by the keycap of any key (not shown) and the surround-type soundproof element 23D while the keycap is depressed and moved downwardly relative to the base plate (not shown) to collide and contact with the corresponding surround-type soundproof element 23D on the membrane circuit board 22D. Since the surround-type soundproof element 23D is capable of absorbing the kinetic energy of the keycap, the impact resulted from the collision is alleviated and the click sound to be transmitted to the base plate is decreased. Moreover, since the sealed space is defined by the keycap and the surround-type soundproof element 23D, the sound generated in the sealed space is blocked.

Figure 15:
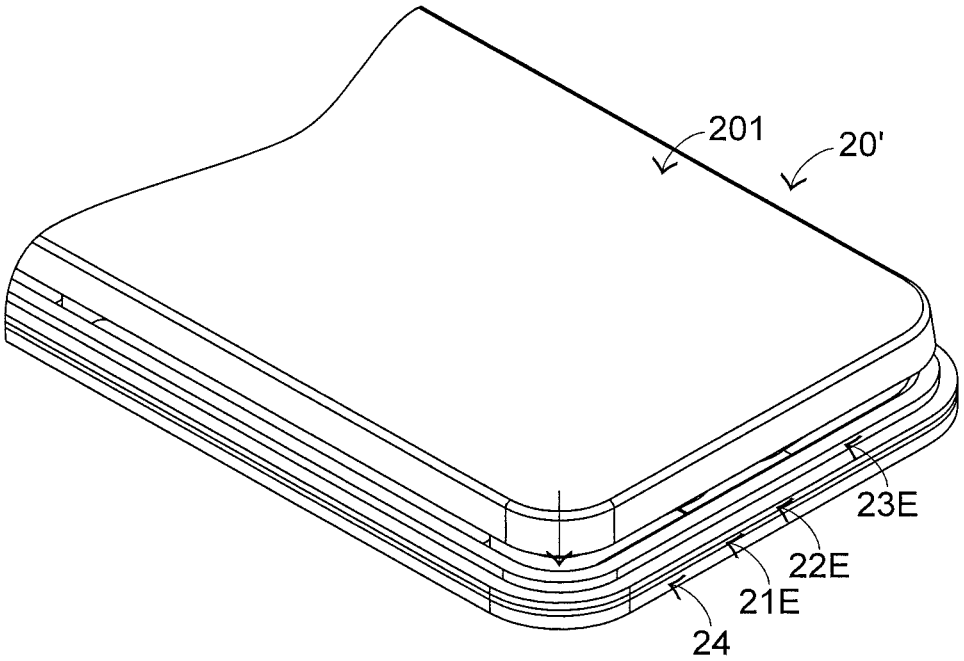
FIG. 15 is a schematic perspective view illustrating a portion of a keyboard device according to a fifth embodiment of the present invention, in which the keycap of the key is not depressed.
Figure 16:
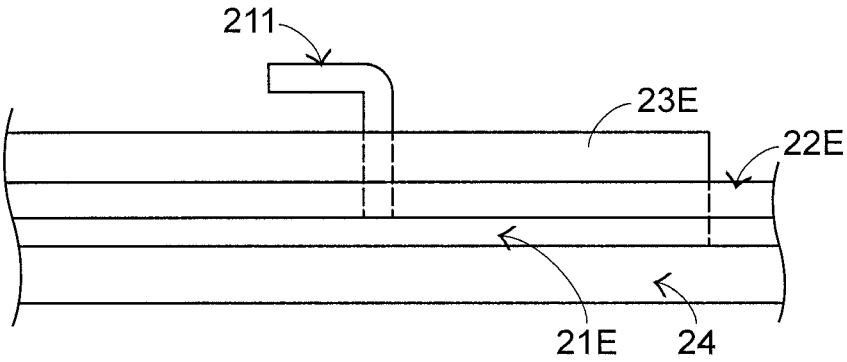
FIG. 16 is a schematic cross-sectional view illustrating portions of a light guide plate, a base plate, a membrane circuit board and a surround-type soundproof element of the keyboard device as shown in FIG. 15.

FIG. 15 is a schematic perspective view illustrating a portion of a keyboard device according to a fifth embodiment of the present invention, in which the keycap of the key is not depressed. FIG. 16 is a schematic cross-sectional view illustrating portions of a light guide plate, a base plate, a membrane circuit board and a surround-type soundproof element of the keyboard device as shown in FIG. 15. Except for the following items, the structures of the keyboard device of this embodiment are substantially identical to those of the keyboard device of the first embodiment, and are not redundantly described herein. In comparison with the first embodiment, the keyboard device of this embodiment further comprises a light guide plate 24 under the base plate 21E. The light guide plate 24 is used for receiving a light beam from a light-emitting element (not shown) and guiding the light beam upwardly to the plural keys 20 and 20'. The operating principles of the light guide plate 24 are well known to those skilled in the art, and are not redundantly described herein. In this embodiment, the surround-type soundproof element 23E is disposed on a top surface of the light guide plate 24 and penetrated upwardly through the base plate 23E and the membrane circuit board 22E. Similarly, a sealed space is defined by the keycap 201 of any key 20 or 20' and the surround-type soundproof element 23E while the keycap 201 is depressed and moved downwardly relative to the base plate 21E to collide and contact with the corresponding surround-type soundproof element 23E on the light guide plate 24. Since the surround-type soundproof element 23E is capable of absorbing the kinetic energy of the keycap, the impact resulted from the collision is alleviated and the click sound to be transmitted to the base plate 21E is decreased. Moreover, since the sealed space is defined by the keycap 201 and the surround-type soundproof element 23E, the sound generated in the sealed space is blocked.

From the above descriptions, the present invention provides the keyboard device. In the keyboard device, plural surround-type soundproof elements corresponding to the plural keys are formed on the light guide plate, the base plate or the membrane circuit board. When the keycap of any key is moved downwardly relative to the base plate, a click sound is reduced because of the surround-type soundproof element. Since a sealed space is defined by the keycap of any key and the corresponding surround-type soundproof element, the sound generated by the components within the sealed space will be blocked from being transmitted to the region outside the sealed space. Consequently, when the keyboard device is operated by the user, the generated noise is reduced. Moreover, the operating comfort to the user is enhanced. In other words, the keyboard device of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

plural keys, each of the plural keys comprising a keycap;

a base plate, wherein each of the plural keys is connected with the base plate;

a membrane circuit board arranged between the plural keycaps and the base plate, and comprising plural membrane switches corresponding to each of the plural keys; and plural surround-type soundproof elements, each of the plural surround-type soundproof elements being aligned with a corresponding one of the plural keys, and disposed on the base plate or the membrane circuit board, wherein while one of the plural keycaps is depressed and moved downwardly relative to the base plate, a sealed space is defined by the depressed keycap and a corresponding surround-type soundproof element.

2. The keyboard device according to claim 1, wherein when a sound is generated in the sealed space that is defined by the depressed keycap and the corresponding surround-type soundproof element, the sound is blocked by the corresponding surround-type soundproof element.

3. The keyboard device according to claim 1, wherein at least one of the plural surround-type soundproof elements is formed by a screen printing process, a transfer printing process, a dispensing process or an adhesive attaching process.

4. The keyboard device according to claim 1, wherein at least one of the plural surround-type soundproof elements is disposed on the base plate and penetrated upwardly through the membrane circuit board.

5. The keyboard device according to claim 1, wherein at least one of the plural keys further comprises a connecting element, wherein the connecting element is enclosed by the corresponding surround-type soundproof element, the connecting element is connected between the base plate and the depressed keycap, and the keycap is movable upwardly or downwardly relative to the base plate through the connecting element.

6. The keyboard device according to claim 1, wherein at least one of the plural surround-type soundproof elements is an elastic vibration absorber or a sound absorber.

7. The keyboard device according to claim 6, wherein the elastic vibration absorber is made of silicone rubber or pressure sensitive adhesive (PSA).

8. The keyboard device according to claim 1, wherein the membrane circuit board comprises plural film layers in a stack form, and at least one of the plural surround-type soundproof elements is formed on a top surface one of the plural film layers.

9. The keyboard device according to claim 8, wherein the plural film layers comprise an upper film layer and a lower film layer, wherein a first circuit pattern is formed on the upper film layer, a second circuit pattern is formed on the lower film layer, the first circuit pattern comprises plural upper contacts, and the second circuit pattern comprises plural lower contacts, wherein each of the upper contacts and a corresponding lower contact are separated from each other by a spacing interval and collectively defined as a membrane switch.

10. The keyboard device according to claim 8, wherein at least one of the plural film layers is made of polycarbonate (PC), polyethylene terephthalate (PET), polymethylmethacrylate (PMMA), polyurethane (PU) or polyimide (PI).

11. The keyboard device according to claim 1, wherein at least one of the plural keys comprises a stabilizer bar, a first end of the stabilizer bar is connected with the base plate, and the stabilizer bar is enclosed by the corresponding surround-type soundproof element and pivotally coupled to the depressed keycap, and/or at least one of the plural keys comprises a reinforcement element, and the reinforcement element is located under the depressed keycap.

12. The keyboard device according to claim 11, wherein the stabilizer bar comprises a transverse bar part and a hook part, the hook part is located at an end of the transverse bar part, and the transverse bar part is pivotally coupled to the depressed keycap, wherein the base plate comprises at least one connecting structure, the connecting structure is protruded upwardly from the base plate and comprises a locking hole, and the hook part of the stabilizer bar is penetrated through the locking hole.

13. A keyboard device, comprising:

plural keys, each of the plural keys comprising a keycap;

a base plate, wherein each of the plural keys is connected with the base plate;

a membrane circuit board arranged between the plural keycaps and the base plate, and comprising plural membrane switches corresponding to each of the plural keys;

a light guide plate located under the base plate, wherein when a light beam is received by the light guide plate, the light beam is guided upwardly to the plural keys by the light guide plate; and plural surround-type soundproof elements, each of the plural surround-type soundproof elements being aligned with a corresponding one of the plural keys, disposed on the light guide plate and penetrated upwardly through the base plate and the membrane circuit board, wherein while one of the plural keycaps is depressed and moved downwardly relative to the base plate, a sealed space is defined by the depressed keycap and a corresponding surround-type soundproof element.

14. The keyboard device according to claim 13, wherein when a sound is generated in the sealed space that is defined by the depressed keycap and the corresponding surround-type soundproof element, the sound is blocked by the corresponding surround-type soundproof element.

15. The keyboard device according to claim 13, wherein at least one of the plural surround-type soundproof elements is formed by a screen printing process, a transfer printing process, a dispensing process or an adhesive attaching process.

16. The keyboard device according to claim 13, wherein at least one of the plural keys further comprises a connecting element, wherein the connecting element is enclosed by the corresponding surround-type soundproof element, the connecting element is connected between the base plate and the depressed keycap, and the keycap is movable upwardly or downwardly relative to the base plate through the connecting element.

17. The keyboard device according to claim 13, wherein at least one of the plural surround-type soundproof elements is an elastic vibration absorber or a sound absorber.

18. The keyboard device according to claim 17, wherein the elastic vibration absorber is made of silicone rubber or pressure sensitive adhesive (PSA).

19. The keyboard device according to claim 13, wherein at least one of the plural keys comprises a stabilizer bar, a first end of the stabilizer bar is connected with the base plate, and the stabilizer bar is enclosed by the corresponding surround-type soundproof element and pivotally coupled to the depressed keycap, and/or at least one of the plural keys comprises a reinforcement element, and the reinforcement element is located under the depressed keycap.

20. The keyboard device according to claim 19, wherein the stabilizer bar comprises a transverse bar part and a hook part, the hook part is located at an end of the transverse bar part, and the transverse bar part is pivotally coupled to the depressed keycap, wherein the base plate comprises at least one connecting structure, the connecting structure is protruded upwardly from the base plate and comprises a locking hole, and the hook part of the stabilizer bar is penetrated through the locking hole.

* * * * *